US005727993A

United States Patent [19]

Kodate

[11] Patent Number: 5,727,993

[45] **Date of Patent: *Mar. 17, 1998**

[54] PLASTIC FLEXIBLE GRINDING STONE

[75] Inventor: Tadao Kodate, Ohmiya, Japan

[73] Assignee: Joybond Co., Inc., Katsushika-ku, Japan

[ * ] Notice: The term of this patent shall not extend beyond the expiration date of Pat. No. 5,476,416.

[21] Appl. No.: 555,763

[22] Filed: Nov. 9, 1995

Related U.S. Application Data

[63] Continuation of Ser. No. 102,972, Jul. 28, 1993, Pat. No. 5,476,416.

[30] Foreign Application Priority Data

Apr. 6, 1993 [JP] Japan ..... 5-160398

[51] Int. Cl.[6] ..... B24B 7/00

[52] U.S. Cl. ..... 451/59; 451/526; 451/103

[58] Field of Search ..... 451/103, 104, 451/113, 526, 523, 540

[56] References Cited

U.S. PATENT DOCUMENTS

| | | |
|---|---|---|
| 4,150,955 | 4/1979 | Samuelson . |
| 4,264,337 | 4/1981 | Fenster et al. . |
| 4,421,526 | 12/1983 | Strickman et al. . |
| 4,512,859 | 4/1985 | Inoue . |
| 5,125,191 | 6/1992 | Rhoades . |
| 5,152,809 | 10/1992 | Mattesky . |
| 5,203,883 | 4/1993 | Perry . |

FOREIGN PATENT DOCUMENTS

| | | |
|---|---|---|
| 0 196 832 | 10/1986 | European Pat. Off. . |
| 1-97572 | 4/1989 | Japan . |
| 4-11335 | 2/1992 | Japan . |
| 92/00153 | 1/1992 | WIPO . |

OTHER PUBLICATIONS

English translation of Japanese Patent Application 4–11335 (Feb. 28, 1992).

English translation of Japanese patent Application 1–97572 (Apr. 17, 1989).

Cryovac, "MPD 2055 Film," 2 pages (publication date is unknown but it is at least as early as Oct. 1995).

*Primary Examiner*—Robert A. Rose

*Attorney, Agent, or Firm*—Conley, Rose & Tayon, P.C.

[57] ABSTRACT

The plastic flexible grinding stone according to the present invention comprises a plastic flexible material having mixed therewith a powder synthetic detergent and an abrasive such as silica sand and calcium carbonate composed of grains from 3 to 50 μm in diameter, and is capable of removing simultaneously minute protrusions and stain from coated surfaces such as of rolling stocks.

86 Claims, 1 Drawing Sheet

PLASTIC FLEXIBLE GRINDING STONE

This is a continuation of application Ser. No. 08/102,972 filed Jul. 28, 1993 now U.S. Pat. No. 5,476,416.

BACKGROUND OF THE INVENTION

1. Field of the Invention

The present invention relates to a plastic flexible grinding stone for use in removing, by polishing, small protrusions which generate on a coated surface of rolling stocks and industrial machines, as well as in removing stain and oil films from the surface of window glasses.

2. Prior Art

When rolling stocks are placed in parking lots near to railways and iron works, or in places close to construction sites where a coating operation is conducted, iron powder and paint mist fly onto the coated surface of the rolling stocks and adhere thereto to form minute protrusions. Such unfavorable protrusions were conventionally removed by polishing the surface using a compound or a sandpaper.

However, when a compound or a sandpaper is applied to the surface to remove the protrusions, not only the protrusions but also the coated surface are brought into contact with the abrasive to form scratches or flaws on the coated surface. As illustrated schematically in FIG. 3(*a*), it can be seen that this type of polishing suffers very poor operability, because the abrasive force is fully (100%) exerted on the coated surface if the abrasive force is fully applied to the protrusions.

With a view to ameliorate the poor operability of the conventional method, the present to inventors has have previously proposed in JP-B-4-11335 (the term "JP-B-" as referred to herein signifies "an examined published Japanese patent application"), a plastic flexible grinding stone comprising a plastic flexible material having mixed therewith fine abrasive such as silica sand and calcium carbonate. When polishing is conducted using the proposed grinding stone, however, as shown in FIG. 3(*b*) no (0%) polishing force is exerted on the coated surface when the polishing force is fully(100%) applied to the protrusions. Accordingly, it can be seen that a favorable operability is realized for the protrusions, but that the stain cannot be removed from the coated surface.

Conventional grinding stones include plastic flexible ones comprising a plastic flexible material having incorporated therein silica sand and calcium carbonate. The protrusions having formed by adhesion of minute granules or droplets to the coated surface can be removed completely using those grinding stones, however, the stain was left for another means for its removal.

SUMMARY OF THE INVENTION

An object of the present invention is to obtain a smooth and plain coated surface by polishing, and yet removing stain from the smooth and plain surface. Accordingly, the present invention comprises controlling both the polishing force being exerted to the protrusions and the polishing force being applied to the planar surface.

The object of the present invention can be accomplished by a plastic (transformable by pressure but incapable of recovering its initial form upon release of pressure) flexible grinding stone comprising a plastic flexible material having mixed therewith a powder of a synthetic detergent and at least one type of fine abrasive composed of grains from 3 to 50 μm in diameter and selected from the group consisting of silica sand, calcium carbonate, alumina, ceramics, and Green Carborundum (silicon carbide abrasive).

The powder of the synthetic detergent is composed of grains from 30 to 1,500 μm in diameter. The powder of the synthetic detergent is mixed at an amount of from 0.5 to 20 parts by weight with respect to 100 parts by weight of the flexible material. The size of the grains of the synthetic detergent is confined to the range above, because grains too large in size cause the grains to protrude from the polishing surface, whereas grains too small in size make it difficult to achieve a homogeneously mixed state in the flexible material. The amount of the synthetic detergent is limited to the range above. If the amount is too small, the stain is insufficiently removed from the surface; if the amount is too large, on the other hand, fine abrasive tends to appear excessively on the surface so as to impair the polished surface.

DETAILED DESCRIPTION OF THE INVENTION

The present invention is illustrated in greater detail referring to a non-limiting example below. It should be understood, however, that the present invention is not to be construed as being limited thereto.

EXAMPLE

A plastic flexible grinding stone was produced by mixing 100 parts by weight of a petroleum resin (polybutene in the present example) as a plastic flexible material with 65 parts by weight of fine silica sand and calcium carbonate grains from 20 to 30 μm in diameter, and 5 parts by weight of a powder synthetic detergent composed of grains 500 μm in diameter. The powder synthetic detergent may be a soap of any type having a cleaning power.

Figure 1:
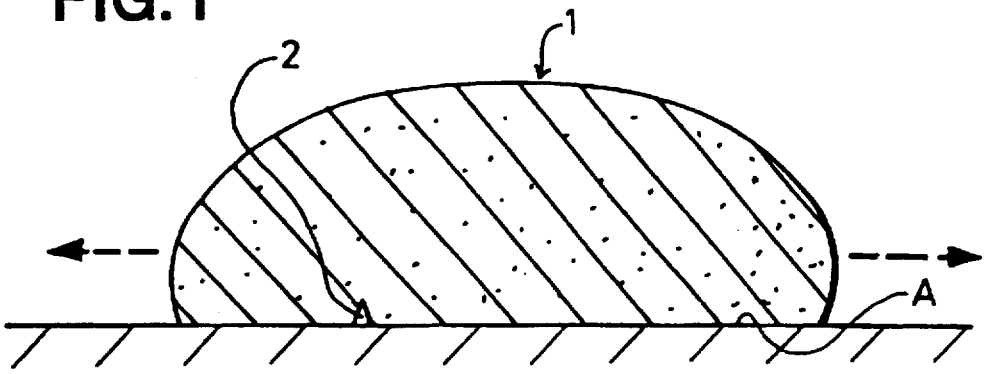
FIG. 1 is an explanatory figure showing a plastic flexible grinding stone according to the present invention in use.
Figure 2:
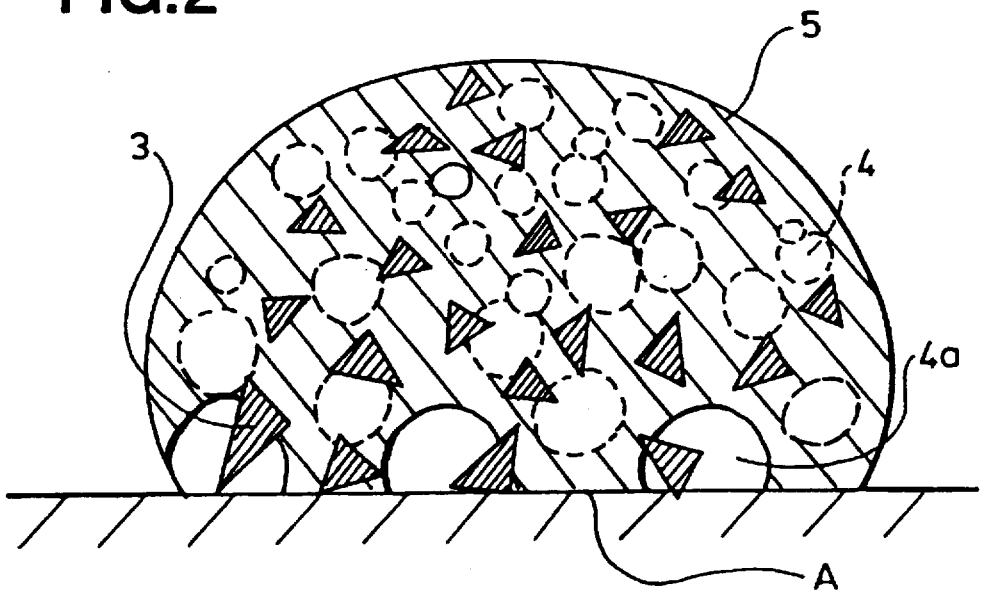
FIG. 2 is a cross sectional view of a plastic flexible grinding stone with the abrasive thereof forming protrusions against the polishing surface.

Referring to FIG. 1, the flexible grinding stone 1 above was used for removing a small protrusion 2 (0.5 mm in height and 1 mm in width) from the coated surface. The flexible grinding stone was pressed against a planar coated surface A to form a flat plane on the flexible grinding stone. Fine abrasive 3 and powder synthetic detergent 4 are distributed within a flexible material 5 as shown in FIG. 2. By reciprocating the planar surface of the flexible grinding stone 1 on the coated surface having the protrusion 2 thereon, the small protrusion 2 was removed completely from the coated surface in about 30 seconds. The stain on the coated surface was removed at the same time. A coated surface as plain and smooth as the surface before polishing was obtained free from scratches and flaws by the polishing operation.

Referring again to FIG. 2, a pore 4*a* can be seen to open on the surface in contact with the coated planar surface A, due to the dissolution of the powder synthetic detergent 4. The open pore 4*a* facilitates the fine abrasive to stick against the polishing surface. In this manner, the polishing speed of the plain surface is accelerated.

Hard fine grains such as of alumina, ceramics, and Green Carborundum may be incorporated in the flexible material as the fine abrasive 3 in the place of the aforementioned grains of silica sand and calcium carbonate. Those fine grains may be used either alone or as a mixture of two or more selected therefrom. The fine abrasive grains in the example were confined to a diameter in the range of 20 to 30 μm, but the size may be freely selected within a range of from 3 to 50 μm depending on the object of polishing. The amount of the fine abrasive such as the fine grains of silica sand and calcium carbonate may be varied within a range of from 60 to 80 parts by weight with respect to 100 parts weight of the flexible material.

In removing small protrusions from the coated surface using the plastic flexible grinding stone according to the present invention, the flexible grinding stone is pressed against a flat and hard plane to form a flat surface on the grinding stone. At this stage, the fine abrasive is buried inside the flat surface of the grinding stone to leave no edges thereof sticking out from the flat surface of the flexible grinding stone.

When the flat surface of the flexible grinding stone is placed over the small protrusion on the coated surface, the small protrusion bores a small hole on the flat surface of the flexible grinding stone and accommodates itself therein. This stage is illustrated in FIG. 1. When the flexible grinding stone is repeatedly reciprocated on the coated surface along the direction indicated with the arrows shown in FIG. 1, the flat surface of the flexible grinding stone moves with its surface being cut with the small protrusion. Since the fine abrasive is not pressed uniformly by the small protrusion in this stage, the edges of the fine abrasive stick out from the flexible material.

Accordingly, the fine abrasive sticking out from the flexible material is brought forcibly into contact with the small protrusion to conduct polishing. The flat surface having formed on the flexible grinding stone is also brought into contact with the coated surface in this case, however, the coated surface suffers no scratches or flaws because the edges of the fine abrasive do not stick out from the flat surface of the flexible material.

Figure 3A:
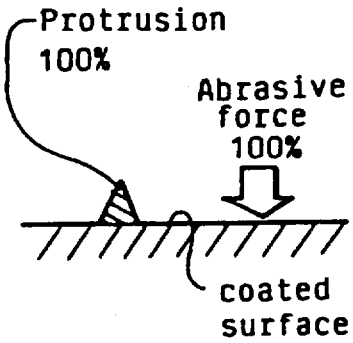
FIG. 3 is a schematic figure provided as an explanatory means to show the exertion of polishing force against the protrusions and stain.
Figure 3B:
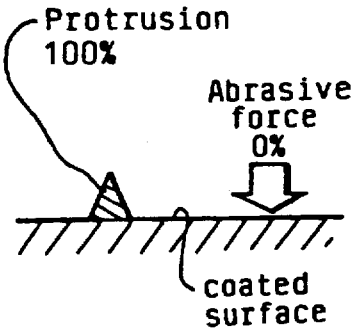
Figure 3C:
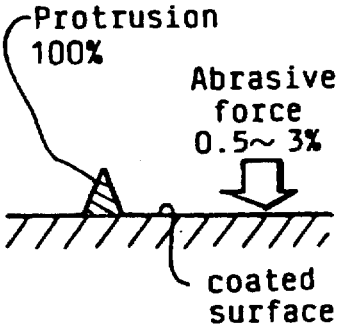

Water may be sprayed to the region on which the flexible grinding stone is moved or to the flexible grinding stone. By taking this means, the powder detergent being incorporated into the flexible grinding stone dissolves into the water to allow the fine abrasive to be exposed on the surface. The amount of the exposed fine abrasive can be controlled by the amount of the powder detergent being incorporated into the flexible grinding stone. The fine abrasive grains sticking out from the polishing surface immediately slip into the flexible material upon detection of a resistance on the polishing surface. In this manner, the polishing force against a flat surface is exerted at about 1/80 to 1/100 of the force applied to a protrusion (in a case 5% by weight of a powder synthetic detergent is added to the grinding stone). This signifies a pertinent force is applied to both the protrusion and the surface stain in conducting polishing as shown in FIG. 3(*c*); specifically, 0.5 to 3% of a polishing force is applied to the stain with respect to 100% of the force applied to the protrusion.

The polishing ability against a flat surface may be controlled in the range of from 1/30 to 1/200 by varying the content of the powder synthetic detergent depending on the object of polishing.

The polished state and the removal of the stain were evaluated while changing the addition of the powder synthetic detergent 4 with respect to 100 parts by weight of the flexible material 5. The results are summarized in Table 1. In the evaluation, the polishing speed signifies the time consumed for removing a protrusion 0.5 mm in height and 1 mm in width, and the speed for removing the stain refers to the time necessary for removing the stain around the protrusion. The frictional force in this case was evaluated from the degree of the force applied by the operator to the grinding stone. A flexible grinding stone comprising 65 parts by weight of fine abrasive grains 25 μm in average diameter was used. A conventional flexible grinding stone containing the same fine abrasive but no powder synthetic detergent was also evaluated for comparison. The results are summarized in Table 1.

TABLE 1

| Content of Detergent (pts. wt.) | Speed of Polishing (sec) | Speed of Stain removal (sec) | Frictional Force | Evaluation |
|---|---|---|---|---|
| 0 | 30 | Unable to remove | Large | Poor |
| 0.5 | 26 | 48 | Medium | Fair |
| 3 | 25 | 38 | Medium | Fair |
| 10 | 20 | 20 | Small | Good |
| 20 | 19 | 20 | Small | Good |
| 25 | 31 | 22 | Small | Poor to Fair |

Table 1 shows that the stain can be rapidly removed by adding 0.5 parts by weight or more of a powder synthetic detergent, but that the polishing speed for a protrusion is lowered by adding the detergent in excess of 20 parts by weight. Furthermore, it can be seen that the polishing can be conducted with a small frictional force by adding 0.5 parts by weight or more of a powder synthetic detergent.

In removing both the protrusion and the stain from a coated surface, it is preferred that the protrusion and the stain are removed within the same duration of time, or the protrusion is removed faster than the stain. It is not favorable that the stain be removed faster than the protrusion, because the polishing marks of the protrusion may somewhat remain on the coated surface. Accordingly, by using a flexible grinding stone having added therein a powder synthetic detergent at an amount of from 0.5 to 20 parts by weight, the stain can be removed completely upon finishing the removal of the protrusion to yield a favorable operability.

Furthermore, in the comparative example above, scratches were found to be formed around the protrusion. However, the examples according to the present invention suffered no scratches or flaws and yielded a flat and smooth surface around the polished area because of the lubricity imparted to the grinding stone.

Then, grinding stones containing powder synthetic detergent 4 with varying grain diameter were produced to evaluate the polishing state and the removal of the stain. The results are summarized in Table 2 below. The evaluation was carried out in the same manner as in the previous evaluation whose results are summarized in Table 1. A flexible grinding stone comprising 65 parts by weight of fine abrasive grains 25 μm in average diameter was used, and the powder synthetic detergent was added at an amount of 10 parts by weight.

TABLE 2

| Diameter of Detergent (μm) | Speed of Polishing (sec) | Speed of Stain removal (sec) | Frictional Force | Evaluation |
|---|---|---|---|---|
| 15 | 28 | 40 | Medium | Poor to Fair |
| 30 | 24 | 32 | Medium | Fair |
| 100 | 20 | 28 | Small | Good |
| 500 | 20 | 26 | Small | Good |
| 1000 | 23 | 23 | Small | Good |
| 1500 | 24 | 25 | Small | Good |
| 2000 | 30 | 25 | Small | Poor to Fair |

Table 2 shows that the polishing of the small protrusions and the removal of stain take a longer time when a grinding stone containing powder synthetic detergent 30 μm or less in diameter is used. Similarly, the removal of small protrusions as well as stain is retarded if grinding stones containing powder detergents exceeding 1,500 μm in grain diameter are used. It can be understood also that the grain diameter of the powder synthetic detergent casts no influence on the frictional force.

In removing both the protrusion and the stain from a coated surface, it is preferred that the protrusion and the stain are removed within the same duration of time, or the protrusion is removed faster than the stain. It is not favorable that the stain be removed faster than the protrusion, because the polishing marks of the protrusion may somewhat remain on the coated surface. Accordingly, it can be seen from Tables 1 and 2 that a preferred range of grain diameter for the powder synthetic detergent is from 30 to 1,500 μm, and that the amount of addition thereof is in the range of from 0.5 to 20 parts by weight with respect to 100 parts by weight of the flexible material. By controlling the amount and the grain size of the detergent within these ranges, the protrusion can be polished faster than removing the stain. This signifies that the stain is removed upon completion of the removal of the protrusions, to thereby yield good operability.

The plastic flexible grinding stone according to the present invention comprises a flexible material having mixed therewith fine abrasive and powder synthetic detergent. Accordingly, the flexible grinding stone according to the present invention is capable of removing small protrusions and stain from the surface without impairing the flat or curved plane such as of coated planes by maintaining a uniform surface against the area to be polished. Furthermore, the grinding stone according to the present invention facilitates rapid operation because it can be worked with a small frictional force. The grinding stone according to the present invention is set as such that the protrusion can be removed more rapidly than the stain. This not only ameliorates the operability, but also prevents the surface flatness from being impaired by the reciprocal movement of the grinding stone after the protrusion is removed.

While the invention has been described in detail and with reference to specific embodiments thereof, it will be apparent to one skilled in the art that various changes and modifications can be made therein without departing from the spirit and scope thereof.

What is claimed is:

1. A plastic flexible tool adapted to remove a protrusion or stain from a surface, comprising:

a plastic flexible material having mixed therewith an abrasive comprising grains from about 3 to 50 μm in diameter, and wherein the tool distributes polishing force per area during use such that, when the tool is applied with polishing force per area to a surface with a protrusion or stain during use, polishing force per area applied to the surface is less than the polishing force per area applied to the protrusion or stain.

2. The plastic flexible tool of claim 1 wherein the plastic flexible tool comprises a substantially flat surface.

3. The plastic flexible tool of claim 1 wherein the tool is adapted to remove a protrusion or stain from a coated surface without substantially scratching the coated surface.

4. The plastic flexible tool of claim 1 wherein the abrasive comprises grains from about 20 to 30 μm in diameter.

5. The plastic flexible tool of claim 1 wherein the tool comprises 60 to 80 parts by weight with respect to 100 parts per weight of the flexible material.

6. The plastic flexible tool of claim 1 wherein the abrasive comprises silica sand.

7. The plastic flexible tool of claim 1 wherein the abrasive comprises calcium carbonate.

8. The plastic flexible tool of claim 1 wherein the abrasive comprises alumina.

9. The plastic flexible tool of claim 1 wherein the abrasive comprises a ceramic material.

10. The plastic flexible tool of claim 1 wherein the abrasive comprises Green Carborundum.

11. The plastic flexible tool of claim 1 wherein the tool is substantially incompressible.

12. The plastic flexible tool of claim 1 wherein the abrasive is substantially buried within the tool.

13. The plastic flexible tool of claim 1 wherein the abrasive is substantially buried within the tool such that when the tool is pressed against a surface the abrasive within the tool does not substantially protrude from the tool.

14. The plastic flexible tool of claim 1 wherein the tool is adapted such that, when the tool is applied with polishing force to a surface, a protrusion on the surface is substantially removed during use as a result of collisions occurring inside the tool between the abrasive and the protrusion.

15. The plastic flexible tool of claim 1 wherein the tool is adapted such that, when applied with polishing force to a coated surface during use, a protusion on the coated surface is substantially removed during use without substantially scratching the coating of the surface.

16. The plastic flexible tool of claim 2 wherein the abrasive is substantially buried inside the plastic flexible tool such that the abrasive does not substantially protrude from the substantially flat surface of the tool.

17. The plastic flexible tool of claim 1 wherein the tool is adapted such that, when the tool is applied with polishing force to a surface with a protrusion during use, polishing force applied to the surface is about 1/30 to 1/200 of polishing force applied to the protrusion, and wherein the protrusion is substantially removed from the surface without substantially scratching the surface.

18. The plastic flexible tool of claim 1 wherein the tool is adapted such that, when the tool is applied with polishing force to a surface with a protrusion during use, polishing force applied to the surface is about 1/80 to 1/100 of polishing force applied to the protrusion.

19. The plastic flexible tool of claim 1 wherein the tool is adapted such that, when the tool is applied with polishing force to a surface with a protrusion during use, polishing force applied to the surface is about 0.5 to 3.0 percent of polishing force applied to the protrusion.

20. The plastic flexible tool of claim 1 wherein the grains have a diameter in the range of between about 20 to 30 μm.

21. The plastic flexible tool of claim 1 wherein the tool comprises a mixture of at least two abrasives from the group consisting of silica sand, calcium carbonate, alumina, ceramics, and Green Carborundum.

22. The plastic flexible tool of claim 1 wherein the tool comprises a substantially flat surface, and wherein the abrasive is substantially buried inside the tool such that abrasive does not substantially protrude from the substantially flat surface of the tool.

23. The plastic flexible tool of claim 1 wherein the plastic flexible tool is adapted, when applied with polishing force to a surface during use, to remove a protrusion or stain from the surface without substantially scratching the surface.

24. The plastic flexible tool of claim 1, wherein the plastic flexible material and abrasive are present in a substantially homogeneously mixed state.

25. The plastic flexible tool of claim 1, further comprising a powder synthetic detergent.

26. The plastic flexible tool of claim 1, further comprising a powder synthetic detergent comprising grains from 30 to 1,500 μm in diameter.

27. The plastic flexible tool of claim 25 wherein the powder synthetic detergent is added at an amount of from 0.5 to 20 parts by weight with respect to 100 parts by weight of the flexible material.

28. The plastic flexible tool of claim 25 wherein the powder synthetic detergent comprises grains from 30 to 1,500 μm in diameter and is added at an amount of from 0.5 to 20 parts by weight with respect to 100 parts by weight of the flexible material.

29. A method of polishing a protrusion or stain from a surface, comprising:

applying a plastic flexible tool to the surface, the plastic flexible tool comprising a plastic flexible material having mixed therewith an abrasive comprising grains from about 3 to 50 μm in diameter; and applying a force to the plastic flexible tool such that a polishing force per area is applied by the plastic flexible tool to a protrusion on the surface, and such that the amount of force per area applied to the surface is about 1/30 to 1/200 of the amount of force per area applied to the protrusion.

30. The method of claim 29, further comprising pressing the plastic flexible tool against the surface, thereby deforming the plastic flexible tool to form a substantially flat surface on the plastic flexible tool.

31. The method of claim 29 wherein the tool is pressed against the surface such that the protrusion substantially embeds itself into the substantially flat surface of the tool.

32. The method of claim 29 wherein the tool is pressed against the surface such that the protrusion substantially embeds itself into the substantially flat surface of the tool, and further comprising reciprocating the substantially flat surface of the plastic flexible tool on the surface such that the protrusion protrudes into the tool and is brought into contact with abrasive inside the tool.

33. The method of claim 29, further comprising reciprocating the substantially flat surface of the plastic flexible tool on the surface.

34. The method of claim 29 wherein the abrasive is substantially buried inside the plastic flexible tool such that the abrasive does not substantially protrude from the substantially flat surface of the tool.

35. The method of claim 30 wherein the abrasive is substantially buried inside the plastic flexible tool such that the abrasive does not substantially protrude from the substantially flat surface of the tool, and wherein the tool is pressed against the surface such that a protrusion substantially embeds itself into the substantially flat surface of the tool, and further comprising reciprocating the substantially flat surface of the plastic flexible tool on the surface such that the protrusion protrudes into the tool and is forcefully contacted with abrasive inside the tool.

36. The method of claim 35 wherein the surface is not forcefully contacted with abrasive.

37. The plastic flexible tool of claim 1 wherein the abrasive is located flush with an outer surface of the flexible tool.

38. The method of claim 35 wherein force is applied to the protrusion and the surface, and wherein the amount of force applied to the protrusion is about 1/80 to 1/100 of the amount of force applied to the surface.

39. The method of claim 35 wherein a force is applied to the protrusion, and wherein about 0.5 to 3.0 percent of such force is substantially simultaneously applied to the surface.

40. The method of claim 29, further comprising adding water to the surface.

41. The method of claim 29, further comprising removing the stain or protrusion from the surface without substantially scratching the surface.

42. The plastic flexible tool of claim 1 wherein the abrasive is located flush with an outer surface of the flexible tool, and wherein the abrasive slips within the outer surface of the tool upon detecting resistance from the surface.

43. A method of polishing a protrusion or stain from a coated surface, comprising:

applying a plastic flexible tool to the coated surface, the plastic flexible tool comprising a plastic flexible material having mixed therewith an abrasive comprising grains from about 3 to 50 μm in diameter;

pressing the plastic flexible tool against the coated surface to form a substantially planer surface on the plastic flexible tool; and reciprocating the substantially planar surface of the plastic flexible tool with polishing force on the coated surface for less than about 30 seconds, thereby applying a polishing force per area to the coated surface and to the protrusion or stain on the coated surface, the polishing force per area applied to the coated surface being less than the polishing force per area applied to the protrusion or stain.

44. The method of claim 43 wherein the plastic flexible tool has a shape which is transformable by pressure but incapable of recovering its initial form upon release of pressure.

45. The method of claim 43 wherein the abrasive comprises grains from about 20 to 30 μm in diameter.

46. The method of claim 43 wherein the plastic flexible tool comprises 60 to 80 parts by weight of abrasive with respect to 100 parts by weight of flexible material.

47. The method of claim 43 wherein the abrasive is flush with an outer surface of the flexible material, and wherein the abrasive slips within the flexible material upon detecting a resistance from the surface.

48. The method of claim 43 wherein the abrasive is flush with an outer surface of the flexible material, and wherein the abrasive slips within the flexible material upon detecting a resistance from the surface such that the force applied to the surface is lessened by slipping of the abrasive.

49. The method of claim 43 wherein the protrusion or stain is substantially removed in less than about 30 seconds.

50. The method of claim 43 wherein the protrusion is removed in a time at least about as great as the time in which the stain is removed.

51. The method of claim 43 wherein the flexible tool comprises a mixture of at least two abrasives from the group consisting of silica sand, calcium carbonate, alumina, ceramics, and Green Carborundum.

52. The method of claim 43 wherein the flexible material is substantially uniformly applied to the surface.

53. The method of claim 43 wherein the flexible material is applied to a curved surface, and the flexible material substantially conforms to the curved surface.

54. The method of claim 43 wherein the abrasive is flush with an outer surface of the flexible material, and wherein the abrasive slips within the flexible material upon detecting a resistance from the surface, and wherein the protrusion or stain is removed from the surface as a result of contact between the abrasive and the protrusion or stain, and wherein the slipping of the abrasive within the flexible material inhibits scratching of the surface by the abrasive.

55. The method of claim 43 wherein the amount of force per area applied to the surface is about 1/30 to 1/200 of the amount of force per area applied to the protrusion.

56. The method of claim 43 wherein the amount of force per area applied to the surface is less than 3/100 of the amount of force per area applied to the protrusion.

57. A method of polishing a protrusion or stain from a surface, comprising:

applying a plastic flexible tool to the surface, the plastic flexible tool comprising a plastic flexible material having mixed therewith an abrasive comprising grains from about 3 to 50 μm in diameter; and applying a force to the plastic flexible tool such that a polishing force per area is applied by the plastic flexible tool to a protrusion or stain on the surface, and such that the amount of force per area applied to the surface is less than the amount of force per area applied to the protrusion or stain.

58. The method of claim 57, further comprising pressing the plastic flexible tool against the coated surface to form a substantially flat surface on the plastic flexible tool.

59. The method of claim 57, further comprising reciprocating the substantially planar surface of the plastic flexible tool with polishing force on the coated surface for less than about 30 seconds, thereby applying the polishing force per area to the coated surface and to the protrusion or stain on the coated surface.

60. The method of claim 57 wherein the surface is coated, and wherein the protrusion or stain is removed from the coated surface without substantially scratching the coated surface.

61. The method of claim 57 wherein the tool is pressed against the surface such that the protrusion substantially embeds itself into the substantially flat surface of the tool.

62. The method of claim 57 wherein the tool is pressed against the surface such that the protrusion substantially embeds itself into the substantially flat surface of the tool, and further comprising reciprocating the substantially flat surface of the plastic flexible tool on the surface such that the protrusion protrudes into the tool and is brought into contact with abrasive inside the tool.

63. The method of claim 57 wherein the amount of force per area applied to the surface is about 1/30 to 1/200 of the amount of force per area applied to the protrusion or stain.

64. The method of claim 57 wherein the amount of force per area applied to the surface is less than about 3/100 of the amount of force per area applied to the protrusion or stain.

65. The method of claim 57 wherein the abrasive comprises grains from about 20 to 30 μm in diameter.

66. The method of claim 57 wherein the tool comprises 60 to 80 parts by weight with respect to 100 parts per weight of the flexible material.

67. The method of claim 57 wherein the abrasive is substantially buried inside the plastic flexible tool such that the abrasive does not substantially protrude from the substantially flat surface of the tool.

68. The method of claim 58 wherein the abrasive is substantially buried inside the plastic flexible tool such that the abrasive does not substantially protrude from the substantially flat surface of the tool, and wherein the tool is pressed against the surface such that a protrusion substantially embeds itself into the substantially flat surface of the tool, and further comprising reciprocating the substantially flat surface of the plastic flexible tool on the surface such that the protrusion protrudes into the tool and is forcefully contacted with abrasive inside the tool.

69. The method of claim 57 wherein the surface is coated, and wherein the coated surface is not forcefully contacted with abrasive.

70. The method of claim 68 wherein force is applied to the protrusion and the surface, and wherein the amount of force applied to the protrusion is about 1/30 to 1/200 of the amount of force applied to the surface.

71. The method of claim 68 wherein force is applied to the protrusion and the surface, and wherein the amount of force applied to the protrusion is about 1/80 to 1/100 of the amount of force applied to the surface.

72. The method of claim 68 wherein a force is applied to the protrusion, and wherein about 0.5 to 3.0 percent of such force is substantially simultaneously applied to the surface.

73. The method of claim 43, further comprising adding water to the surface.

74. The method of claim 57, further comprising adding water to the surface.

75. The method of claim 57, further comprising removing the stain or protrusion from the surface without substantially scratching the surface.

76. The method of claim 57 wherein the flexible tool comprises a mixture of at least two abrasives from the group consisting of silica sand, calcium carbonate, alumina, ceramics, and Green Carborundum.

77. The method of claim 57 wherein the flexible material is substantially uniformly applied to the surface.

78. The method of claim 57 wherein the flexible material is applied to a curved surface, and the flexible material substantially conforms to the curved surface.

79. The plastic flexible tool of claim 1 wherein the tool is adapted to remove the stain and the protrusion in less than about 30 seconds during use.

80. The plastic flexible tool of claim 1 wherein the tool is adapted to remove the stain and the protrusion in less than about 21 seconds during use.

81. The plastic flexible tool of claim 1 wherein the tool is adapted to remove the stain in at least the amount of time required for the removal of the protrusion.

82. The plastic flexible tool of claim 1 wherein the abrasive extends from an outer surface of the flexible tool, and wherein the tool is adapted such that abrasive slips within the outer surface of the tool upon detecting resistance from the surface such that the polishing force per area applied to the surface is lessened by the slipping of the abrasive during use.

83. The plastic flexible tool of claim 1 wherein the abrasive is located flush with an outer surface of the flexible tool, and wherein the tool is adapted such that abrasive slips within the outer surface of the tool upon detecting resistance from the surface such that the polishing force per area applied to the surface is lessened by the slipping of the abrasive during use.

84. The plastic flexible tool of claim 1 wherein the tool is adapted such that it substantially conforms to the shape of the shape of a curved plane on the surface during use.

85. The plastic flexible tool of claim 1 wherein the abrasive extends from an outer surface of the flexible material, and wherein the tool is adapted such that the abrasive slips within the flexible material upon detecting a resistance from the surface, and wherein the stain is removed from the surface as a result of contact between the abrasive and the stain, and wherein the slipping of the abrasive within the flexible material inhibits scratching of the surface by the abrasive during use.

86. The plastic flexible tool of claim 1 wherein the abrasive is flush with an outer surface of the flexible material, and wherein the tool is adapted such that the abrasive slips within the flexible material upon detecting a resistance from the surface, and wherein the stain is removed from the surface as a result of contact between the abrasive and the stain, and wherein the slipping of the abrasive within the flexible material inhibits scratching of the surface by the abrasive during use.

* * * * *

UNITED STATES PATENT AND TRADEMARK OFFICE

CERTIFICATE OF CORRECTION

PATENT NO. : 5,727,993

DATED : March 17, 1998

INVENTOR(S) :

PLASTIC FLEXIBLE GRINDING STONE

It is certified that error appears in the above-identified patent and that said Letters Patent is hereby corrected as shown below:

Col. 1, line 10, after "which", please replace "generate" with --are generated--
Col. 1, line 15, after "near", please delete the word "to".
Col. 1, line 32, after "present", please replace "to inventors" with --inventor--
Col. 1, line 32, after "has", please delete "have"
Col. 1, line 35, please delete "flexible"
Col. 1, line 36, please delete "flexible"
Col. 1, line 37, before "fine", please add --a--.
Col. 1, line 45, after "plastic", please delete "flexible"
Col. 1, line 46, after "plastic", please delete "flexible"
Col. 3, line 54, before "case", please replace "a" with --one--.
Col. 3, line 56, after "signifies", please add --that--.
Col. 5, line 15, after "stain", please replace "take" with --takes--.
Col. 5, line 44, before "from" please replace the phrase "and stain" with the phrase --or stains--.

Claim 5, col. 6, line 13, after "weight", please add --of abrasive--.
Claim 66, col. 9, line 66, after "weight", please add --of abrasive--.

UNITED STATES PATENT AND TRADEMARK OFFICE

CERTIFICATE OF CORRECTION

PATENT NO. : 5,727,993

DATED : March 17, 1998

INVENTOR(S) : PLASTIC FLEXIBLE GRINDING STONE

It is certified that error appears in the above-identified patent and that said Letters Patent is hereby corrected as shown below:

On the third line of the Abstract, please delete the phrase "a powder synthetic detergent and."
On the sixth line of the Abstract, please replace the phrase "simultaneously minute protrusions and stain" with the phrase --protrusions or stains--.

Signed and Sealed this

Thirteenth Day of June, 2000

*Attest:*

*Attesting Officer*

Q. TODD DICKINSON

*Director of Patents and Trademarks*